US008302213B2

(12) United States Patent
Kriesel

(10) Patent No.: US 8,302,213 B2
(45) Date of Patent: Nov. 6, 2012

(54) HELMETS AND VESTS

(75) Inventor: Matthew Kriesel, Melrose, WI (US)

(73) Assignees: IG Holdings LLC, Ettrick, WI (US); Diversified Gel Products, LLC, Farmington, MN (US)

( * ) Notice: Subject to any disclaimer, the term of this patent is extended or adjusted under 35 U.S.C. 154(b) by 1781 days.

(21) Appl. No.: 10/962,189

(22) Filed: Oct. 8, 2004

(65) Prior Publication Data

US 2006/0075544 A1 Apr. 13, 2006

(51) Int. Cl.
*A41D 1/04* (2006.01)

(52) U.S. Cl. ..... 2/102; 2/103; 2/2.5; 428/316.6; 428/71; 428/76; 428/68

(58) Field of Classification Search ..... 2/2.5, 102, 2/103; 428/316.6, 71, 76, 68
See application file for complete search history.

(56) References Cited

U.S. PATENT DOCUMENTS

| | | | | |
|---|---|---|---|---|
| 371,301 | A | 10/1887 | Burhans | |
| 710,999 | A | 10/1902 | Powers | |
| 757,473 | A | 4/1904 | Lemon | |
| 2,800,701 | A | 7/1957 | Watts et al. | |
| 3,049,515 | A | 8/1962 | Damusis | |
| 3,061,556 | A | 10/1962 | Gemeinhardt | |
| 3,067,149 | A | 12/1962 | Dombrow et al. | |
| 3,072,582 | A | 1/1963 | Frost | |
| 3,221,869 | A | 12/1965 | Paasche | |
| 3,392,406 | A * | 7/1968 | Pernini et al. | 2/2.5 |
| 3,659,845 | A | 5/1972 | Quinton | |
| 3,711,812 | A | 1/1973 | Cherry | |
| 3,747,684 | A | 7/1973 | Wallen | |
| 3,880,274 | A | 4/1975 | Bechtloff et al. | |
| 3,905,925 | A | 9/1975 | Vervloet | |
| 3,929,026 | A | 12/1975 | Hofmann | |
| 4,057,595 | A | 11/1977 | Rauner et al. | |
| 4,072,635 | A | 2/1978 | Jeram | |
| 4,170,086 | A | 10/1979 | Hills | |
| 4,333,248 | A | 6/1982 | Samuels | |
| 4,334,676 | A | 6/1982 | Schonenberger | |
| 4,342,122 | A | 8/1982 | Abraham et al. | |
| 4,346,205 | A | 8/1982 | Hiles | |
| 4,369,081 | A | 1/1983 | Curry et al. | |
| 4,377,045 | A | 3/1983 | Aurensan | |
| 4,456,642 | A | 6/1984 | Burgdorfer et al. | |
| 4,504,089 | A | 3/1985 | Calvert et al. | |
| 4,513,825 | A | 4/1985 | Murphy | |

(Continued)

FOREIGN PATENT DOCUMENTS

| | | |
|---|---|---|
| EP | 0477533 | 4/1992 |

(Continued)

*Primary Examiner* — Alissa Tompkins
(74) *Attorney, Agent, or Firm* — Clise, Billion & Cyr, P.A.; Benjamin C. Armitage; Timothy B. Clise

(57) ABSTRACT

Disclosed is an assembly which can include a hardened outer shell and an inner surface comprising a polymeric gel. The polymeric gel is enclosed within an envelope having opposed layers and is attached to the outer hardened surface cover. The hardened outer surface cover may be comprised of most any material known within the art. The sporting or shooting vest comprises a garment including gel-filled pockets or envelopes whereby impact can be absorbed and dissipated. Additionally, the outer layer of the shooting vest may be comprised of a Kevlar material wherein the vest would become a ballistic vest.

20 Claims, 4 Drawing Sheets

U.S. PATENT DOCUMENTS 4,614,337 A 9/1986 Schonenberger
4,631,758 A 12/1986 Newman et al.
4,635,927 A 1/1987 Shu
4,635,928 A 1/1987 Ogden et al.
4,643,418 A 2/1987 Bart
4,644,380 A 2/1987 Zemel
4,659,074 A 4/1987 Taitel et al.
4,664,371 A 5/1987 Viander
4,664,380 A 5/1987 Kuebler
4,749,181 A 6/1988 Pittaway et al.
4,756,949 A 7/1988 Spence et al.
4,761,843 A 8/1988 Jay
4,948,131 A 8/1990 Nakanishi
4,953,861 A 9/1990 Nakanishi
4,967,493 A 11/1990 Mues
4,991,318 A 2/1991 Cornell
4,999,068 A 3/1991 Chiarella
5,026,744 A 6/1991 Callander
5,066,259 A 11/1991 Acker
5,112,061 A 5/1992 Lamle
5,178,387 A 1/1993 Kuebler
5,236,198 A 8/1993 Haines et al.
5,252,373 A 10/1993 Ganske et al.
5,314,180 A 5/1994 Yamagishi et al.
5,322,280 A 6/1994 Wu
5,325,537 A * 7/1994 Marion ..... 2/462
5,374,057 A 12/1994 Lai et al.
5,509,484 A 4/1996 Landi et al.
5,566,476 A 10/1996 Bertrand et al.
5,853,849 A 12/1998 Nishio et al.
5,951,441 A 9/1999 Dalebout et al.
6,027,674 A * 2/2000 Yates ..... 264/113
6,093,468 A 7/2000 Toms et al.
6,343,385 B1 2/2002 Katz
6,380,291 B1 4/2002 von Hellens
6,418,832 B1 * 7/2002 Colvin ..... 89/36.02
6,485,446 B1 * 11/2002 Brother et al. ..... 602/20
6,497,057 B1 12/2002 Lee et al.
6,500,080 B2 12/2002 Severa et al.
6,503,161 B2 1/2003 Bothwell
6,537,164 B1 3/2003 Hsu
6,588,511 B1 7/2003 Kriesel et al.
6,701,529 B1 * 3/2004 Rhoades et al. ..... 2/2.5
6,896,065 B2 5/2005 Kriesel et al.
6,966,855 B2 11/2005 Yu
7,041,719 B2 5/2006 Kriesel et al.
7,052,426 B2 5/2006 Battat et al.
7,093,301 B1 * 8/2006 Moore, Jr. ..... 2/2.5
7,105,607 B2 9/2006 Chen
7,134,929 B2 11/2006 Chen
7,138,079 B2 11/2006 Pearce
7,193,002 B2 3/2007 Chen
2001/0007180 A1 7/2001 Bordin et al.
2003/0060312 A1 3/2003 Pai
2003/0109625 A1 6/2003 Galimberti et al.
2003/0236313 A1 12/2003 Pearce
2004/0127615 A1 7/2004 Wentworth et al.
2004/0132587 A1 7/2004 Leighton et al.
2004/0146541 A1 7/2004 Chen
2004/0191446 A1 9/2004 Kriesel
2005/0003911 A1 1/2005 Yu
2006/0075544 A1 4/2006 Kriesel
2006/0084855 A1 4/2006 Teschner et al.
2006/0287147 A1 12/2006 Kriesel
2008/0026658 A1 1/2008 Kriesel
2008/0250729 A1 10/2008 Kriesel
2009/0042676 A1 2/2009 Kriesel

FOREIGN PATENT DOCUMENTS

JP 2001112570 A2 4/2001
JP 2003253107 9/2003
WO 9424206 10/1994
WO 0114313 A1 3/2001
WO 0212749 A2 2/2002

* cited by examiner

2

HELMETS AND VESTS

CROSS-REFERENCE TO RELATED APPLICATION

This application claims priority to U.S. patent application Ser. No. 10/681,831, filed Oct. 8, 2003 the contents of which are hereby incorporated in their entirety.

FIELD OF THE INVENTION

Furthermore, in the sporting industry there is also a need for a resilient shock absorbing vest and/or a ballistic vest.

BACKGROUND

Safety helmets are indispensable items of safety equipment for a wide variety of purposes such as riding a bicycle or motorcycle, functioning in hazardous work environments, and also for a variety of recreational sports. Generally, a helmet is structured to provide shock-absorption properties so as to protect a wearer from potentially deadly injury resulting from a direct blow to the wearer's head. Existing helmet designs typically include a substantially rigid outer shell, with the inside of this rigid outer shell being typically lined with a combination of foam and rubber-like padding which tightly surrounds a wearer's head on an underside of the helmet surface. The materials utilized in forming such helmets usually include a deformable synthetic foam material. In the event of a direct blow to the hard outer shell of the helmet, the force of the blow is transferred to the foam and rubber-like padding surrounding the helmet assembly. Upon an impact to the helmet surface, the foam and rubber-like padding deform in a gradual manner so as to absorb a portion of the impact energy and reduce the effects of the impact upon the wearer.

Bicycling is an international recreational activity and means of transport that maintains a serious risk of head injury. In addition to bicycling other recreational activities including rollerblading, and skateboarding all maintain a serious risk of head injury. Head injury is a leading cause of accidental death and disability among children in the United States, resulting in over 100,000 hospitalizations every year. Studies have shown that children under the age of 14 are more likely to sustain head injuries than adults, and that children's head injuries are often more severe than those sustained by adults. In general, head injuries fall into two main categories—focal and diffuse. Focal injuries are limited to the area of impact, and include contusions, hematomas, lacerations and fractures. Diffuse brain injuries involve trauma to the neural and vascular elements of the brain at the microscopic level. The effect of such diffuse damage may vary from a completely reversible injury, such as a mild concussion, to prolonged coma and death.

Other activities, such as roller skating, in-line skating and skate boarding are typically conducted on the same types of surfaces as bicycling and can generate speeds similar to bicycling. Therefore, similar patterns of injury and benefits of helmet usage can be expected. Similar design considerations would apply for protective helmets for skating activities, in terms of impact attenuation. One difference between bicycling injuries and skating injuries is that, while 90 percent of bicycle-related head injuries occur on the front of the head, 80 percent of skating-related head injuries occur on the back of the head. Consequently, protective helmets for skating activities may have somewhat different design considerations in terms of coverage and location of protective padding. Protective helmets for aquatic activities, such as windsurfing, kayaking or water skiing, have similar design considerations in terms of impact attenuation, with the additional requirement for moisture resistance during long term immersion. Protective helmets for some activities, such as skiing or mountaineering, in addition to impact attenuation, have a need for a broad range of service temperatures.

DETAILED DESCRIPTION

Figure 3:
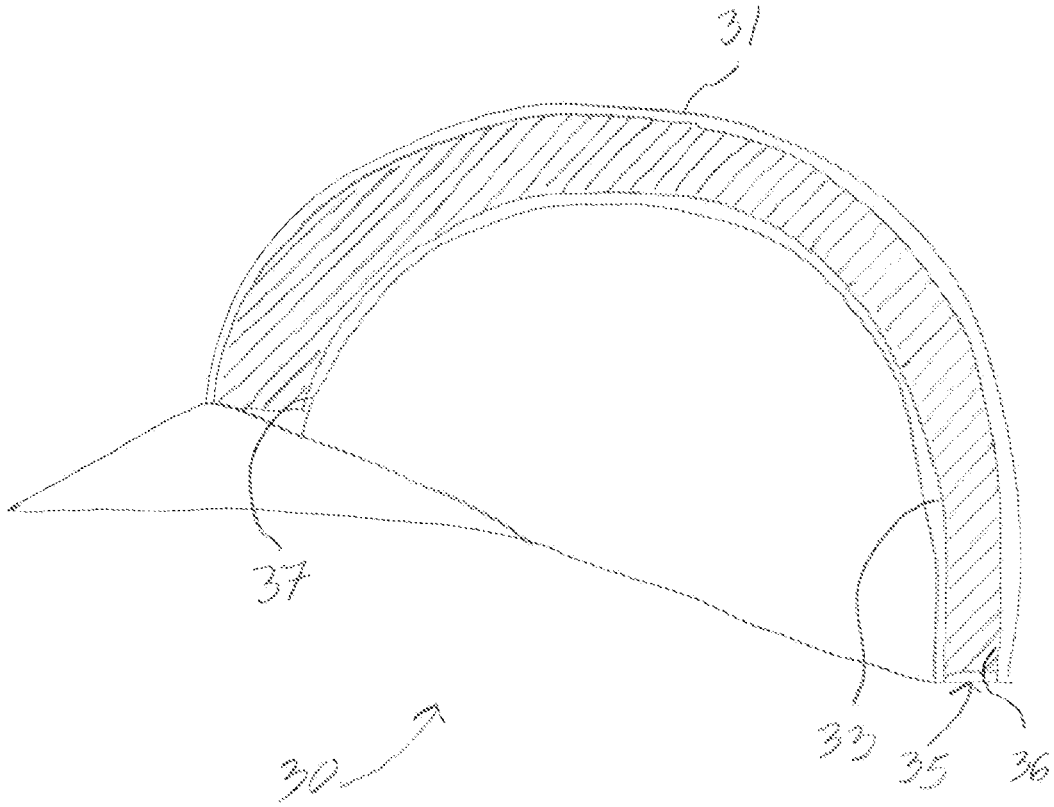
FIG. 3 shows a helmet according to the description herein.
Figure 4:
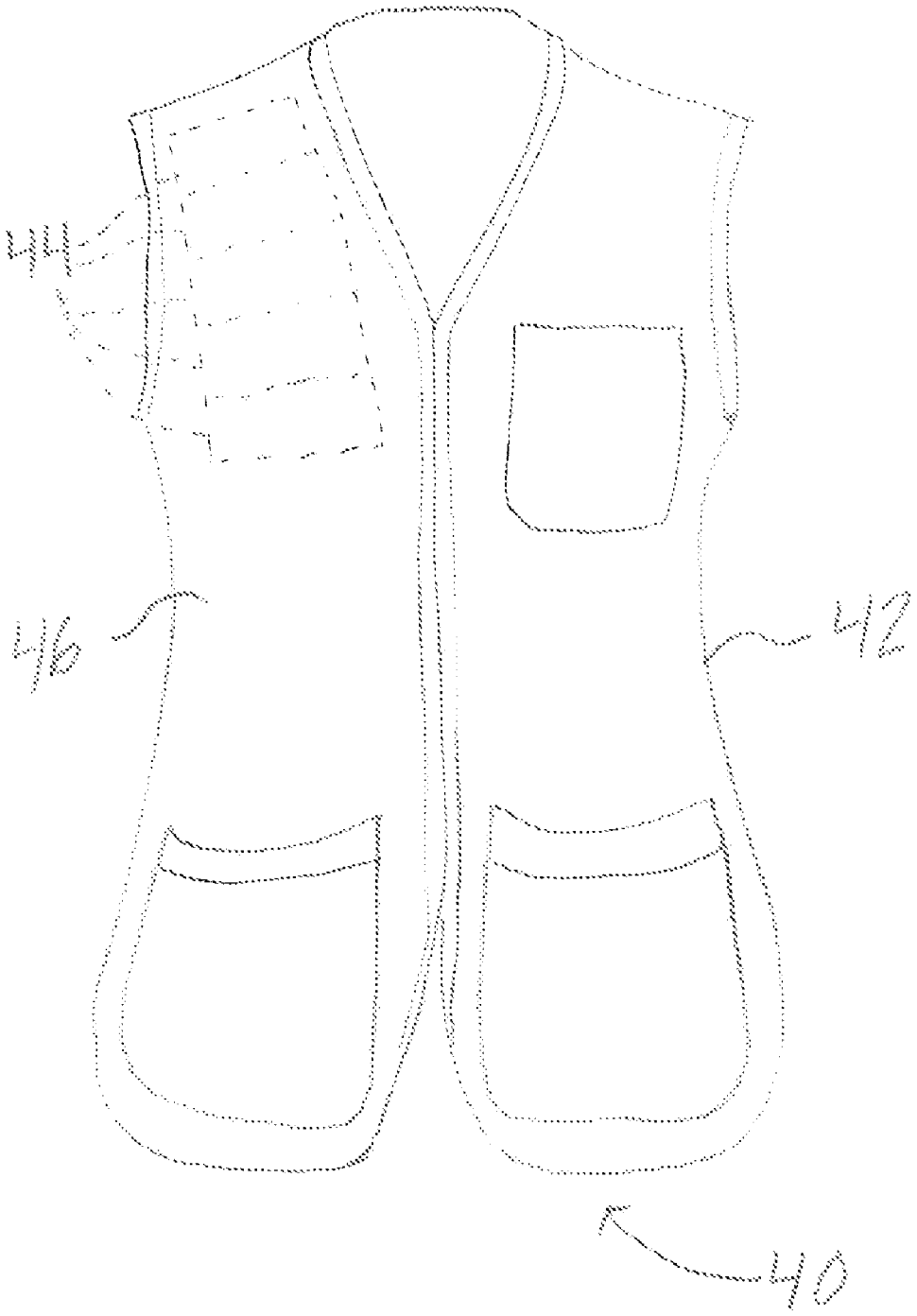
FIG. 4 shows a vest according to the description herein.

The present invention comprises a resilient helmet assembly 30 (FIG. 3) which can include a hardened outer shell 31 and an inner surface 33 comprising a polymeric gel. The polymeric gel is enclosed within an envelope 35 having opposed layers 36, 37 and is attached to the outer hardened surface cover. The hardened outer surface cover may be comprised of most any material known within the art. The sporting or shooting vest 40 is sleeveless and comprises a garment 42 covering the upper body of a wearer including gel-filled pockets or envelopes 44 whereby impact can be absorbed and dissipated. Additionally, the outer layer 46 of the shooting vest may be comprised of a Kevlar material wherein the vest would become a ballistic vest.

Opposed Layers

The opposed layers (e.g., 36, 37) defining an envelope therebetween, can be fused together using heat if the layers are formed from a material conducive to such fusing. An example of a fusible material would be a vinyl sheet or other polymeric material that melts and fuses upon solidification. Additionally the layers may be joined using mechanical means such as stitching, stapling or other fasteners. Adhesives may also be used to join the layers together, or a combination of any of the methods mentioned above or those known in the art may be used for joining the layers.

The reinforced polymeric shock absorbing envelope may be comprised of one or more envelopes residing in a single larger envelope. The two opposed layers may be joined at multiple points creating a plurality of envelopes encompassing the gel compound.

The opposed layers may be formed from a sheet of a resilient polymeric material. Additionally, the opposed layers may be formed from a woven or a nonwoven material capable of containing the gel and able to withstand rupturing upon impact. Furthermore, it is contemplated that the envelope may be comprised of more than two layers and that the envelope may be encased in a further envelope to add protection and durability to the overall envelope.

Polymeric Gel

The energy absorbing polymeric compound may be comprised of most any polymeric gel. The gel incorporated into the envelope is both viscoelastic and shock attenuating.

An example gel compound is one that comprises an epoxidized vegetable oil combined with a prepolymer and a thermoplastic polymer. Additionally, a catalyst or an accelerant may be added to the energy absorbing compound to aid in the formation of the compound. Typically the activator or accelerant is a metal activator such as an alkyl tin compound.

The elastomeric compound includes an epoxidized vegetable oil which can function as a plasticizer. By way of example, the epoxidized vegetable oils can include epoxidized soybean oil, epoxidized linseed oil and epoxidized tall oil. Additional examples of epoxidized vegetable oils include epoxidized com oil, epoxidized cottonseed oil, epoxidized perilla oil and epoxidized safflower oil. Epoxidized vegetable oils are typically obtained by the epoxidation of triglycerides of unsaturated fatty acid and are made by epoxidizing the reactive olefin groups of the naturally occurring triglyceride oils. Typically, the olefin groups are epoxidized using a peracid. One example of an acceptable epoxidized vegetable oil is an epoxidized soybean oil, Paraplex G-62, available from C.P. Hall Company of Chicago, Ill. Paraplex G-62 can function as both a plasticizer and a processing aid and is a high molecular weight epoxidized soybean oil on a carrier having an auxiliary stabilizer for a vinyl group.

The elastomeric composition includes a prepolymer. Various prepolymers may be utilized in the present composition so long as they do not substantially hinder the desired viscoelastic, shock-attenuating attributes of the elastomeric compound. Typically, the prepolymer is an isocyanate.

The thermoplastic component can include most any thermoplastic compound having elastomeric properties. In one embodiment of the gel, thermoplastic compounds comprising polyurethane are excluded. Acceptable thermoplastic component includes polydienes. An example polydiene includes polybutadiene. Typically, the activator or catalyst is an alkyl tin compound is also added to the gel compound. A specific example of an alkyl tin compound is a dioctyltin carboxylate.

It is within the scope of the present invention to incorporate other additives such as fillers, pigments, surfactants, plasticizers, organic blowing agents, as stabilizers, and the like, in the manufacture of the reinforced polymeric shock absorbing envelope.

A reinforced polymeric pad for absorbing energy, in a helmet, vest or other structure described herein, can comprise a polymeric gel and a substrate contained within an envelope. The pad exhibits low rebound velocity and high hysteresis, among other desirable characteristics which are conducive to the function of a good energy attenuating material. The polymeric pad is capable of repeatedly absorbing shock without structural damage and without appreciable sag due to prolonged exposure to continuous dynamic loading.

Generally the reinforced polymeric pad comprises a polymeric gel and substrate enveloped by a top and bottom layer. The substrate has a density less than that of the polymeric gel. The substrate may be formed from a foamed plastic and may be a continuous sheet or have perforations placed throughout. The polymeric gel can be formed from an epoxidized vegetable oil, a thermoplastic polymer and a prepolymer. The epoxidized vegetable oil generally encompasses either an epoxidized soybean or linseed oil, or combinations of the two. The top and bottom layer can be formed from a non-woven resilient material.

In an additional embodiment, the reinforced polymeric pad comprises a gel formed from an epoxidized vegetable oil and a thermoplastic polymer which is substantially free of a polyurethane, and a substrate formed from a foamed plastic. The foamed plastic has a density less than that of the polymeric gel. The pad comprises an envelope formed from two opposed layers joined at the periphery. The gel and substrate are contained within the envelope, and in one embodiment, the gel surrounds the substrate.

A further embodiment includes a method of forming a reinforced polymeric pad for use in a helmet, vest or other structure described herein can include joining two opposed layers to form an envelope containing within a polymeric gel and a substrate. The opposed layers may be fused together at the periphery using heat or may be mechanically joined. The layers are typically formed from a resilient non-woven material.

Figure 1:
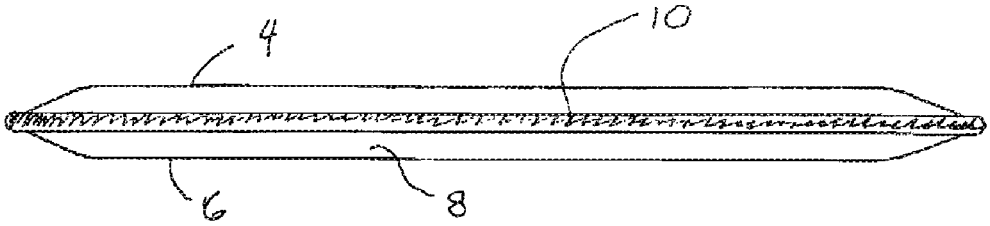
FIG. 1 is a side view of the present reinforced polymeric pad depicting the shock absorbing envelope comprising both the polymeric gel and the substrate.
Figure 2:
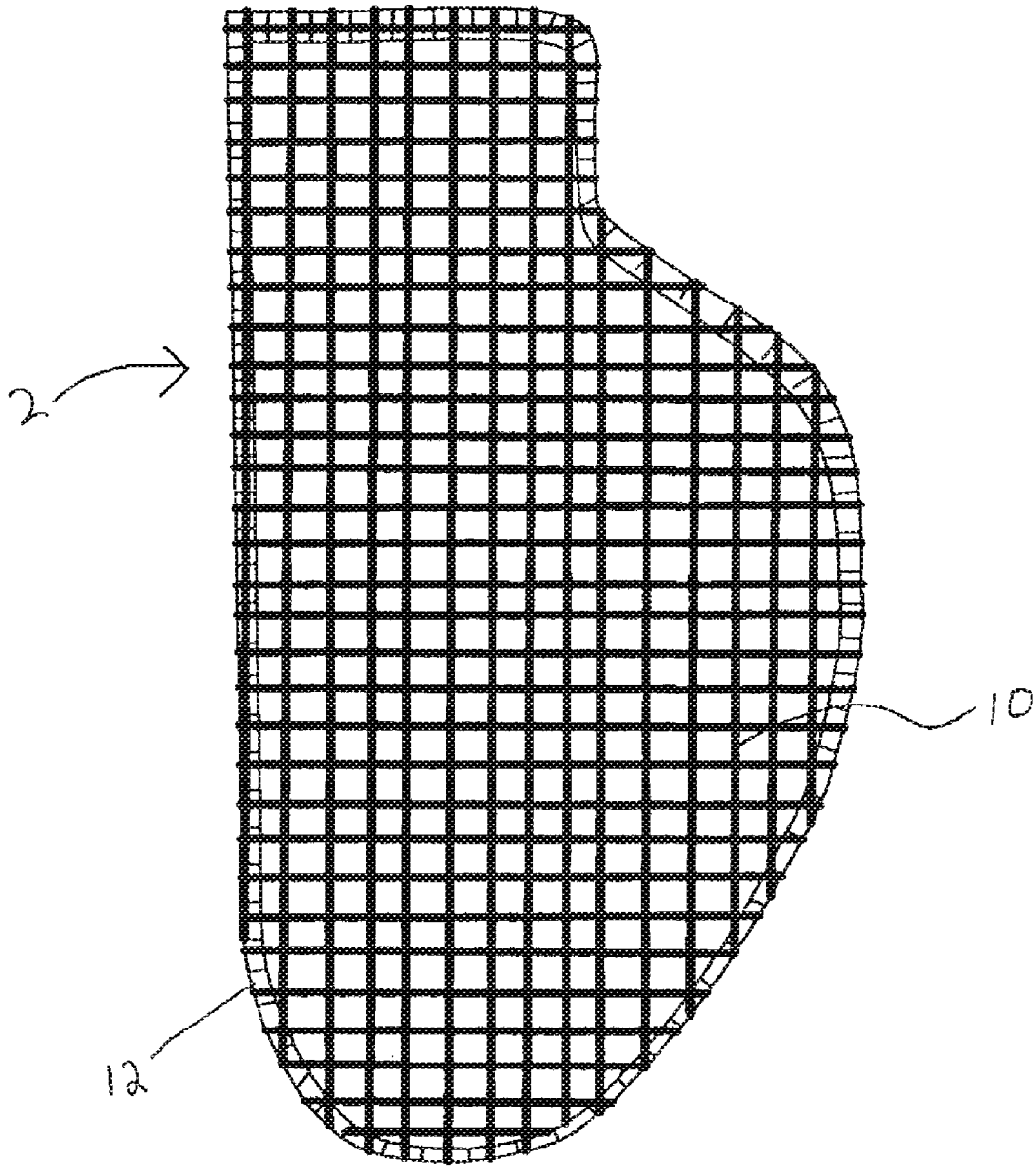
FIG. 2 depicts a further embodiment of the reinforced polymeric pad depicting the substrate having various perforations enveloped in an envelope comprising the polymeric gel.

In greater detail and with reference to FIGS. 1 and 2, the examples of the present invention comprise a reinforced polymeric pad including a shock absorbing envelope comprising a polymer gel and a substrate. The shock absorbing envelope is formed by the joining of two opposed layers 4, 6 joined at the periphery to comprise a compartment formed between the two layers 4, 6 wherein a substrate and polymeric gel are contained.

The layers 4, 6 defining the envelope are typically formed from a non-woven material such as a resilient polymeric polymer sheet and are capable of withstanding repeated impact. The two opposed layers 4, 6 defining the envelope in which the polymeric material and substrate 10 are contained, can be formed of most any material capable of providing impact resistance.

The substrate 10 typically has a density less than that of the polymeric gel 8 and decreases the overall weight of the pad 2 while adding some rigidity to it. The substrate 10 may be formed of most any material so long as it does not impede the impact resistance of the reinforced pad 2. For example, the substrate 10 may be formed from a foamed plastic such as a polyvinyl chloride, or the substrate 10 may be formed from a felt material.

The polymeric gel 8 component of the reinforced pad 2 can be comprised of most any elastomeric material. While the gel 8 component is described as a polymeric gel 8, the term "gel" is not meant to be restrictive and is only used to describe the component as having gel-like qualities. The use of the term "gel" is not intended to be restrictive as to describing only a conoidal system, but is used to describe any semi-solid substance that is both resilient and elastic. Typically, the polymeric gel 8 is formed from an epoxidized vegetable oil combined with a prepolymer and a thermoplastic polymer. The gel 8 compound is capable of absorbing impact and energy and has a density greater than that of the substrate 10.

The opposed layers 4, 6 defining an envelope therebetween, can be fused together using heat if the layers 4, 6 are formed from a material conducive to such fusing. An example of a fusible material would be a vinyl sheet or other polymeric material that melts and fuses upon solidification. Additionally the layers 4, 6 may be joined using mechanical means such as stitching, stapling or other fasteners. Adhesives may also be used to join the layers 4, 6 together, or a combination of any of the methods mentioned above or those known in the art may be used for joining the layers 4, 6.

The reinforced polymeric shock absorbing pad 2 may be comprised of one or more envelopes residing in a single pad 2. The two opposed layers 4, 6 may be joined at multiple points creating a plurality of envelopes encompassing the substrate 10 and gel compound.

The opposed layers 4, 6 may be formed from a sheet of a resilient polymeric material. Additionally, the opposed layers 4, 6 may be formed from a woven or a non-woven material capable of containing the gel 8 and substrate 10 and able to withstand rupturing upon impact. Furthermore, it is contemplated that the envelope may be comprised of more than two layers 4, 6 and that the envelope may be encased in a further envelope to add protection and durability to the pad 2.

The substrate 10 functions essentially as a filler for providing both weight reduction in the pad 2 and rigidity. The substrate 10 may be formed from a foam 5 polymer such as a PVC, or a nonwoven material such as a felt pad. Additionally, other materials are also known in the art, which have a density less than the gel 8 and can provide the same functions. The substrate 10 can be formed from a continuous sheet of material or can have perforations as illustrated in FIG. 2. Additionally, the substrate 10 may substantially span the entire envelope or just reside in a portion of the envelope. In one embodiment it is contemplated that the substrate 10 spans at least 50% or more of the area of the pad 2. In a further embodiment, the substrate 10 spans at least 75% of the pad 2.

The thickness of the substrate 10 is limited only be the desired ultimate thickness of the pad 2 and the desired overall weight in the pad 2. Furthermore, the substrate 10 may be a continuous sheet or be comprised of multiple sheets within the pad 2. It is further contemplated that the substrate 10 may be comprised of particles such as foamed beads of PVC, which are less dense that the polymeric gel 8.

The energy absorbing polymeric compound may be comprised of most any polymeric gel. Typically, and in an embodiment, the gel 8 has a density greater than the substrate 10. The gel 8 incorporated into the envelope is both viscoelastic and shock-attenuating.

An example gel 8 compound is one that comprises an epoxidized vegetable oil combined with a prepolymer and a thermoplastic polymer. Additionally, a catalyst or an accelerant may be added to the energy absorbing compound to aid in the formation of the compound. Typically the activator or accelerant is a metal activator such as an alkyl tin compound.

The elastomeric compound includes an epoxidized vegetable oil which can function as a plasticizer. By way of example, the epoxidized vegetable oils can include epoxidized soybean oil, epoxidized linseed oil and epoxidized tall oil. Additional examples of epoxidized vegetable oils include epoxidized corn oil, epoxidized cottonseed oil, epoxidized perilla oil and epoxidized safflower oil. Epoxidized vegetable oils are typically obtained by the epoxidation of triglycerides of unsaturated fatty acid and are made by epoxidizing the reactive olefin groups of the naturally occurring triglyceride oils. Typically, the olefin groups are epoxidized using a peracid. One example of an acceptable epoxidized vegetable oil is an epoxidized soybean oil, Paraplex G-62, available from C.P. Hall Company of Chicago, Ill. Paraplex G-62 can function as both a plasticizer and a processing aid and is a high molecular weight epoxidized soybean oil on a carrier having an auxiliary stabilizer for a vinyl group.

The elastomeric composition includes a prepolymer. Various prepolymers may be utilized in the present composition so long as they do not substantially hinder the desired viscoelastic, shock-attenuating attributes of the elastomeric compound. Typically, the prepolymer is an isocyanate.

The thermoplastic component can include most any thermoplastic compound having elastomeric properties. In one embodiment of the gel 8, thermoplastic compounds comprising polyurethane are excluded. Acceptable thermoplastic component includes polydienes. An example polydiene includes polybutadiene. Typically, the activator or catalyst is an alkyl tin compound is also added to the gel 8 compound. A specific example of an alkyl tin compound is a dioctyltin carboxylate.

It is within the scope of the present invention to incorporate other additives such as fillers, pigments, surfactants, plasticizers, organic blowing agents, as stabilizers, and the like, in the manufacture of the reinforced polymeric shock 10 absorbing pad 2.

It will be understood by those skilled in the art that while the present invention has been discussed above with respect to various preferred embodiments and/or features thereof, numerous changes, modification, additions and deletions can be made thereto without departing from the spirit and scope of the invention as set forth in the following claims.

What is claimed is:

1. A shock absorbing sporting or shooting vest comprising;

a sleeveless vest for covering the upper body of a wearer including an outer shell and a gel filled envelope connected to the outer shell whereby impact can be absorbed and dissipated; and wherein the gel filled envelope comprises a first layer, a second layer opposing the first layer, and a shock attenuating, polymer gel residing between the first and second opposed layers, and wherein the shock attenuating polymer gel includes polymeric material that comprises at least greater than 50% by weight of an epoxidized vegetable oil, a thermoplastic polymer; and a prepolymer.

2. The vest of claim 1, wherein the prepolymer comprises at least one of an isocyanate or an isocyanate monomer, or both.

3. The vest of claim 2, wherein the thermoplastic polymer includes a hydroxy functional thermoplastic elastomer.

4. The vest of claim 2, wherein the thermoplastic polymer includes a polybutadiene.

5. The vest of claim 3, wherein the shock attenuating polymer gel comprises an activator that includes an alkyl tin compound, wherein the epoxidized vegetable oil is selected from the group consisting of soybean oil, linseed oil, and combinations thereof, and wherein the thermoplastic polymer comprises a polydiene.

6. The vest of claim 5, wherein the thermoplastic polymer is substantially free of a polyurethane.

7. The vest of claim 5, wherein the first layer and the second layer are fused together to enclose the shock attenuating, polymer gel.

8. The vest of claim 7, wherein the first layer and the second layer are fused together to form a plurality of envelopes to encompass the shock attenuating, polymer gel.

9. The vest of claim 1, wherein the shock attenuating polymer gel comprises an activator.

10. The vest of claim 9, wherein the activator is an alkyl tin compound.

11. The vest of claim 1, wherein the epoxidized vegetable oil is selected from the group consisting of soybean oil, linseed oil, and combinations thereof.

12. The vest of claim 1, wherein the thermoplastic polymer comprises a polydiene.

13. The vest of claim 1, wherein the thermoplastic polymer is a polybutadiene.

14. The vest of claim 1, wherein the prepolymer comprises at least one of an isocyanate or an isocyanate monomer, or both.

15. The vest of claim 14, wherein the thermoplastic polymer includes a hydroxy functional thermoplastic elastomer.

16. The vest of claim 15, wherein the shock attenuating polymer gel comprises an activator that includes an alkyl tin compound, wherein the epoxidized vegetable oil is selected from the group consisting of soybean oil, linseed oil, and combinations thereof, and wherein the thermoplastic polymer comprises a polydiene.

17. The vest of claim 16, wherein the thermoplastic polymer is substantially free of a polyurethane.

18. The vest of claim 16, wherein the first layer and the second layer are fused together to enclose the shock attenuating, polymer gel.

19. A shock attenuating vest comprising;

a sleeveless vest for covering the upper body of a wearer including an outer shell, a ballistics layer connected to the outer shell, an inner surface and a pocket connected to one of the outer shell, the ballistics layer and the inner surface;

a gel-filled envelope positioned in the pocket, the gel-filled envelope to attenuate and dissipate forces thereon; and wherein the gel filled envelope comprises a first layer, a second layer opposing the first layer, and a shock attenuating, polymer gel residing between the first and second opposed layers, and wherein the shock attenuating polymer gel includes polymeric material that comprises at least greater than 50% by weight of an epoxidized vegetable oil, a thermoplastic polymer; and a prepolymer.

20. The vest of claim 19, wherein the pocket is beneath the outer shell.

* * * * *